US005508108A

United States Patent [19]

Tokiyoski et al.

[11] Patent Number: 5,508,108

[45] Date of Patent: Apr. 16, 1996

[54] HOT MELT INK-THERMAL TRANSFER RECORDING MATERIAL

[75] Inventors: Tomofumi Tokiyoski, Souka; Naomi Yamamoto, Ichikawa; Hiromasa Kondo, Urawa, all of Japan

[73] Assignee: New Oji Paper Co., Ltd., Tokyo, Japan

[21] Appl. No.: 377,601

[22] Filed: Jan. 25, 1995

[30] Foreign Application Priority Data

Jan. 28, 1994 [JP] Japan ..... 6-008823

[51] Int. Cl.[6] ..... B41M 5/26

[52] U.S. Cl. ..... 428/341; 428/195; 428/342; 428/409; 428/423.1; 428/913; 428/914

[58] Field of Search ..... 428/195, 341, 428/342, 409, 423.1, 913, 914

[56] References Cited

FOREIGN PATENT DOCUMENTS 61-144394 7/1986 Japan .

*Primary Examiner*—B. Hamilton Hess

*Attorney, Agent, or Firm*—Armstrong, Westerman, Hattori, McLeland & Naughton

[57] ABSTRACT

A hot melt ink-thermal transfer recording material having a high speed hot melt ink-receiving property and a satisfactory offset printing applicability and being capable of recording clear images with a high durability and useful as a bar code-recording medium, includes an ink-receiving layer formed on a substrate and containing a polyurethane ionomer and a rosin component.

9 Claims, No Drawings

HOT MELT INK-THERMAL TRANSFER RECORDING MATERIAL

BACKGROUND OF THE INVENTION

1. Field of the Invention

The present invention relates to a hot melt ink-thermal transfer recording material for recording hot melt ink images by a thermal transfer recording system. More particularly, the present invention relates to a hot melt ink-thermal transfer recording material having an enhanced ink-receiving property and a satisfactory applicability to offset printing and being capable of recording clear ink images with a high durability and thus useful for recording thereon bar codes.

2. Description of the Related Art

Currently, bar code recording systems are utilized in various fields, for example, merchandise control in department stores and supermarkets, load control in forwarding agents and attendance control in enterprises and offices.

Especially, for the bar code records used in industry, high reliability and durability (persistency) in storage of the record are required.

Recently, for the bar code recording system, various printing methods, for example, the electrophotographic printing method, thermal transfer printing method, and ink-jet printing method have been employed. These printing methods have both merits and demerits.

Namely, among these printing methods, the ink-jet printing method is disadvantageous in that the recorded ink images have a poor resistance to water and fade significantly on exposure to ultraviolet rays. The electrophotographic printing method is disadvantageous in that when the recorded images are brought into contact with a plastic film, for example, a polyvinylidene chloride film, a toner contained in the recorded images is easily dissolved in a plasticizer contained in the plastic film. Accordingly, currently, the hot melt ink-thermal transfer recording method which can record clear images having a higher persistency and durability than those produced by the electrophotographic printing method and the ink-jet printing method has generated strong interest as a bar code recording method. This method is advantageous in that ordinary paper sheets can be used as a recording medium.

The thermal transfer printing method is, however, still unsatisfactory in water resistance, abrasion resistance and difficulty of alteration and thus, its performance should be improved in these categories. Some attempts have been made to reduce these drawbacks by changing the composition of the ink used. However, these attempts have not yet been satisfactory. Therefore, there is strong demand for an improvement of the recording material or medium.

The conventional bar code-recorded material is unsatisfactory, for example, in that when the bar code images are immersed in water for several hours, the ink is separated from the recording material and floats on water, or the ink images are easily removed from the recording material when rubbed with a cosmetic liquid, for example, hair tonic. These disadvantages of the thermal transfer printing method can be removed only by improving the performance of the ink image-receiving material.

Also, due to an increase in bar code treatment speed, the recording material is strongly required to exhibit high speed recordability, an enhanced brightness of the recorded images and a high resolving power. If a conventional paper sheet is used as a recording sheet for a high speed ink thermal transfer printing method, the resultant prints are uneven in ink image quality and have defects of dots due to poor surface smoothness and a low ink-receiving property of the paper sheet.

To improve the surface smoothness of the recording paper sheet, some attempts have been made to control the Bekk smoothness of the paper sheet or to provide a specific thermal transfer ink-receiving layer containing a specific pigment or binder resins. These attempts had a certain improving effect for the surface smoothness. However, the attempts were not completely successful because they resulted in a decrease of the distinctness of the recorded ink images, due to defectively dotted ink images and poor reproducibility of the dotted ink images.

Accordingly, it is recognized that the disadvantages of the conventional ink thermal transfer recording materials cannot be completely removed only by enhancing the surface smoothness thereof or adding a specific pigment or binder resin to the ink-receiving layer. Namely, a hot melt ink type thermal transfer recording material having a high persistency or durability and distinctness of the recorded images, an enhanced ink-receiving property and an excellent reproducibility of dotted ink images has not yet been obtained.

In the conventional thermal transfer recording sheet, it is necessary to use a binder in a very small amount for the ink-receiving layer to enhance the hot melt ink-absorption thereof. Therefore, the resultant ink-receiving layer exhibits a poor surface strength to the printing ink and thus is not suitable for offset printing.

SUMMARY OF THE INVENTION

An object of the present invention is to provide a hot melt ink-thermal transfer recording material having an excellent hot melt ink-receiving property and a satisfactory applicability to offset printing and capable of recording thereon clear ink images having an excellent durability, and thus useful as a bar code recording material.

The above-mentioned object can be attained by the hot melt ink-thermal transfer recording material of the present invention which comprises:

a substrate; and a hot melt ink-receiving layer formed on at least one surface of the substrate and comprising a hot melt ink-receiving resin material comprising a polyurethane ionomer and a rosin compound.

DESCRIPTION OF THE PREFERRED EMBODIMENTS

The inventors of the present invention made an effort to obtain a hot melt ink-thermal transfer recording material having an excellent ink-receiving property, capable of recording thereon clear images free from blanks, spreadings and bridging of the printed dots and having excellent durability, and thus useful as a bar code recording material. As a result, the inventors found that when a hot melt ink-receiving layer is formed from an ink receiving resin material comprising a polyurethane ionomer and a rosin compound on a substrate, the resultant hot melt ink-thermal transfer recording material can satisfy all the above-mentioned requirements. The present invention was completed on the basis of the above-mentioned discovery.

The hot melt ink-thermal transfer recording material of the present invention is characterized in that a hot melt ink-receiving layer is formed, on at least one surface of a substrate which is preferably in the form of a sheet, from an ink-receiving resin material comprising, as principal components, a polyurethane ionomer and a rosin compound.

Generally, in the hot melt ink-thermal transfer recording system, a heated thermal head of a printer is brought into imagewise contact with a hot melt ink ribbon superposed on an ink-receiving layer surface of a recording material, portions of the ink layer of the ink ribbon are melted imagewise and transferred to the ink-receiving layer of the recording material. The ink layer comprises a mixture of a coloring material (pigment) and a wax.

In consideration of the ink-transferring mechanism, the inventors of the present invention attempted to make the softening temperature of the ink-receiving layer close to the softening temperature of the ink layer (wax) of the ink ribbon, and studied the performances of the resultant recording material.

From this study, it was found that a polyurethane ionomer having, preferably a glass-transition temperature of 90° C. or less, more preferably 0° C. to 90° C. enhanced the ink-receiving property of the ink-receiving layer. A softening temperature higher than 90° C. sometimes reduces the ink-receiving property-enhancing effect of the polyurethane ionomer.

In the bar code-recording material, the recorded bar code images are required to have an excellent fastness to abrasion or friction. The polyurethane ionomer exhibits an excellent close adhesion to the printing ink. However, the polyurethane ionomer is not always satisfactory in the fastness-enhancing effect on the recorded ink images. The inventors of the present invention made an effort to enhance the fastness of the recorded ink images and found that a rosin compound mixed with the polyurethane ionomer significantly enhance the fastness of the recorded ink images without reducing the ink-receiving property of the resultant ink-receiving layer. Preferably, the rosin compound has a softening temperature of 130° C. or less, more preferably 45° C. to 130° C., still more preferably 50° C. to 80° C.

Usually, the hot melt ink comprises a mixture of a coloring material with a wax. To enhance an affinity of the ink with the ink-receiving layer, usually, the ink-receiving layer was tried to contain a wax therein. However, the resultant ink-receiving layer had an unsatisfactory ink-receiving property, because, when the ink layer of the ink ribbon is separated from the ink-receiving layer of the recording material after the hot melt ink images are thermally transferred from the ink layer to the ink-receiving layer, the transferred ink images return from the ink-receiving layer to the ink layer.

Where the rosin compound is contained, the resultant ink-receiving layer exhibits an enhanced ink-adhering property, and thus it is assumed that when the ink-receiving layer is separated from the ink layer after the ink images are transferred from the ink layer to the ink-receiving layer, the transferred ink images can be firmly held by and fixed to the ink-receiving layer without returning from the ink-receiving layer to the ink layer.

The rosin compounds having a softening temperature higher than 130° C. exhibit a decreased effect on the enhancement of the ink-receiving property.

The polyurethane ionomer is an ionization product of a polyurethane polymer with metallic ions, for example, Na or Ca ions. The polyurethane ionomer can be uniformly dispersed in the form of fine particles in water due to a high ionizing property thereof, without using a dispersing or emulsifying agent.

The polyurethane resins from which the polyurethane ionomers usable for the present invention have carboxyl groups and include reaction products of polyisocyanate compounds, for example, tolylene diisocyanate, diphenylmethane diisocyanate, naphthalene diisocyanate, tridine diisocyanate, xylene diisocyanate, dicyclohexylmethane diisocyanate, and polymethylene diisocyanates, for example, hexamethylene diisocyanate, with polyol compounds, for example, polyethylene glycol, polypropylene glycol, polytetramethyleneether glycol, glycerol, trimethylolpropane, sorbitol and pentaerythritol. The metal ions usable for the polyurethane ionomers include Na and Ca ions. The metal ions react with the carboxyl groups of the polyurethane resins to thereby cross-link and neutralize the polyurethane molecules.

The polyurethane ionomers usable for the present invention are available, for example, under the trademarks of Hydran HW series, for example, Hydran HW-340, and Hydran AP series, for example, Hydran AP-30F, made by Dainippon Ink and Chemicals Inc.; and the Superflex series, for example, Superflex 100, made by Daiichi Kogyo Seiyaku Co, Ltd.

The rosin compounds usable for the present invention include rosin, hydrogenated rosins, rosin esters and hydrognenated rosin esters. The rosin is obtained as a natural resin of conifer trees and comprises, as principal components, a plurality of resin acids, for example, obietic (silvic) acid, neoabietic acid, dehydroabietic acid, pimaric acid, isopimaric acid, levopimaric acid, sandarachopimaric acid and polasitric acid.

The hydrogenated rosins are prepared by hydrogenating rosin and include dihydrorosin and tetrahydrorosin. The hydrogenation effectively makes rosin colorless and enhances the stability of the rosin at high temperatures.

The rosin esters or hydrogenated rosin esters are prepared by esterifying the rosin or hydrogenated rosins and include methyl esters, ethyl esters, glycerol esters (estergums), diethyleneglycolesters and pentaerythritolesters of the rosin or hydrogenated rosins.

The rosin compounds usable for the present invention are available, for example, under the trademarks of the Cellosol D series, for example, Cellosol D-101, made by Chukyo Yushi K. K., and the Superester E series, for example, Superester E-720 and Superester SE-50, and the Super Light Colored Rosinester series, for example, Super Light Colored Rosinester KR-610, KE-311 and KE-354, made by Arakawa Kagakukogyo K. K.

In the present invention, the weight ratio of the polyurethane ionomer to the rosin compound contained in the ink-receiving layer is not limited to a specific range thereof. Preferably, in the ink-receiving layer, the rosin compound is contained in a content of 5 to 80 parts by dry weight per 100 parts by dry weight of the polyurethane ionomer. When the content of the rosin compound is more than 80 parts by dry weight, sometimes, the resultant ink-receiving layer exhibits a reduced adhering property to the offset printing ink, and when the content is less than 5% by dry weight, the transferred ink images sometimes exhibit a reduced fastness.

To enhance office working properties, for example, writing property and stamping property, and printing properties, of the ink-receiving layer, a pigment may be added in an amount not obstructing the attainment of the object of the present invention to the ink-receiving layer. The pigment may comprise at least one member selected from mineral pigments, for example, ground calcium carbonate, precipitated calcium carbonate, talc, kaolin, calcined kaolin, calcium sulfate, barium sulfate, titanium dioxide, zinc oxide, alumina, magnesium oxide, silica, magnesium aluminosilicate, fine particulate calcium silicate, fine particulate magnesium carbonate, fine particulate precipitated calcium carbonate, bentonite, zeolite and sericite, and organic resinous pigments, for example, polystyrene resins, urea-formaldehyde resins, melamine-formaldehyde resins and acrylic resins.

The ink receiving layer of the present invention optionally contains an additional resinous material comprising at least one member selected from natural and semi-synthetic polymeric materials, for example, starch compounds such as cationic starch compounds, amphoteric starch compounds, oxidized starch, enzyme-modified starch, thermochemically modified starch, esterified starch compounds and etherified starch compounds, cellulose derivatives such as carboxymethyl cellulose and hydroxyethyl cellulose, proteins such as gelatin, casein, and soybean protein, and natural rubber; and synthetic polymeric materials, for example, polyvinyl alcohol, synthetic rubbers such as isoprene rubbers, neoprene rubbers, polydiene polymers such as polybutadiene, polyalkenes such as polybutene, polyisobutylene, polypropylene and polyethylene, polyvinyl polymers such as polyvinyl halides, polyvinyl acetate, polystyrene, polyacrylic acid, polymethacrylic acid, polyacrylic acid esters, polymethacrylic acid esters, polyacrylamide, polymethacrylamide, and polyvinyl ether, polyvinyl copolymers, polyurethane resins, polyester resins, polyamide resins, olefin-maleic anhydride copolymers, and melamine-formaldehyde resins.

The above-mentioned polymers or copolymers may be employed alone or in a mixture of two or more thereof.

The ink-receiving layer of the present invention optionally contains at least one additive selected from, for example, surfactants, pH adjustors, viscosity adjustors, softening agents, gloss agents, waxes, dispersing agents, fluidity adjustors, electric conduction-preventing agents, stabilizers, antistatic agents, cross-linking agents, sizing agents, fluorescent brighteners, coloring materials, ultraviolet ray-absorbing agents, antifoaming agents, water-resisting agents, plasticizers, lubricants, antiseptic agents and perfumes.

In the present invention, the ink-receiving layer is preferably formed in a dry weight of 1 to 7 g/m$^2$, more preferably 1.5 to 4 g/m$^2$ on each side surface of the substrate. When the amount of the ink-receiving layer is less than 1 g/m$^2$, the resultant ink images may exhibit unsatisfactory clarity and durability. Also, when the amount of the ink-receiving layer is more than 7 g/m$^2$, the resultant recording material may have an appearance and hand feel other than those of ordinary paper.

The ink-receiving layer can be formed by any conventional coating method and apparatus, for example, two roll type or metering blade type coating methods and apparatuses. For example, the coating of the ink-receiving layer can be carried out by using a size-press applicator, gate roll coater, billblade coater, short dwell coater, roll coater, blade coater, airknife coater and spraying device.

The substrate usable for the present invention preferably comprises at least one member selected from paper sheets, synthetic paper sheets, nonwoven fabric sheets and synthetic resin films, more preferably paper sheets comprising, as a principal component, pulp fibers.

The paper sheets usable for the substrate preferably contains 5 to 30% by weight, more preferably 10 to 25% by weight of a filler based on the total weight of the pulp fibers. The fillers are located in spaces between the pulp fibers so as to form appropriate small voids and to impart a proper cushioning property to the substrate and thus the performance of the resultant recording material is significantly improved. When the content of the filler is less than 5% by weight, the above-mentioned advantages may not be attained. Also, when the content of the filler is more than 30% by weight, the resultant paper sheet may exhibit an unsatisfactory adhesive strength between the pulp fibers, and thus the resultant ink images, for example, the bar code ink images, formed on the ink-receiving layer may exhibit a decreased durability.

The fillers usable for the substrate paper sheets are preferably selected from pigments and resins usable for ordinary fine paper sheets, for example, mineral pigments, for example, kaolin, calcined kaolin, calcium carbonate, calcium sulfate, barium sulfate, titanium dioxide, talc, zinc oxide, alumina, magnesium oxide, silica, bentonite, zeolite and sericite; and resins, for example, polystyrene resins, urea-formaldehyde resins, melamine-formaldehyde resins and acrylic resins.

As long as the purpose of the present invention can be attained, the substrate paper sheet can contain a conventional additive comprising at least one member selected from anionic, nonionic, cationic and amphoteric yield-enhancing agent, filterability-enhancing agent, paper-strengthening agent, and internal sizing agent. Also, the paper sheet for the substrate can optionally contain an internal additive selected from dyestuffs, fluorescent brightness, pH-adjusters, antifoaming agents, pitch-controlling agents, slime-controlling agents, which are usually added to a pulp slurry for the paper-forming process.

The paper sheet usable for the substrate can be produced by any usual paper-forming process. For example, the production of the paper sheet can be carried out by an acidic paper forming process by which a paper sheet having a pH of about 4.5 is obtained, or by a neutral paper forming process in which an alkaline filler is added to a pulp slurry, and the resultant paper sheet has a pH of about 6 to about 9, namely is weakly acidic, neutral or weakly basic. The paper-forming process can be carried out by using a wire paper machine, twin wire paper machine, cylinder paper machine or a Yankee paper machine.

In the formation of the ink-receiving layer on the substrate, the ink-receiving layer may be formed in a single layer or in multiple layers, for example, two laminated layers. When a multilayered ink-receiving layer is formed, each individual layers may be formed from one and the same coating liquid or two or more coating layers different from each other. Each coating liquid has a composition established in consideration of the property and quality required for each component layer.

The substrate optionally has a backcoat layer formed on the back surface of the substrate and comprising a synthetic resin, pigment, adhesive and/or antistatic agent. The backcoat layer effectively imparts an enhanced curl-preventing property, printability and sheet-feeding and delivering property to the recording material.

Also, the backcoat layer may be further treated with an adhesive agent, magnetic agent, flame-retarding agent, water-resisting agent, oil-resisting agent or antislippage agent. These treatments are effectively used for imparting additional properties to the recording material.

The hot melt thermal transfer recording material of the present invention is preferably finished by a usual drying procedure and/or surface smoothing procedure to adjust the water content thereof to a level of 3 to 10% by weight, more preferably 4 to 8% by weight. In the surface-smoothing procedure, preferably the smoothness of the surface is adjusted to a Bekk smoothness of 150 seconds or more. The surface-smoothed recording material can record thereof ink images having an enhanced clarity and quality. When the Bekk smoothness is less than 150 seconds, the resultant ink-receiving surface of the recording material may exhibit an unsatisfactory ink-receiving property and thus the transferred dots may become defective and the recorded ink images may have a decreased clarity.

In the surface smoothing treatment of the hot melt thermal transfer recording material, the surface-smoothing apparatus is selected in consideration of the required quality thereto, from, for example, super calender, gloss calender and soft calender, and the smoothing procedure is carried out online or offline. The type of the pressing apparatus and the nipping number are controlled so as to meet with the type of the smoothing apparatus used.

EXAMPLES

The present invention will be further explained by the following examples which are merely representative and do not in any way restrict the scope of the present invention.

EXAMPLE 1

A pulp slurry was prepared by dispersing 5 parts by weight of a soft wood kraft pulp (NBKP) having a Canadian standard freeness of 480 ml and 95 parts by weight of a hard wood kraft pulp (LBKP) having a Canadian standard freeness of 480 ml, 1.5 parts by weight of a rosin emulsion sizing agent and 2 parts by weight of aluminum sulfate in fresh water. The resultant pulp slurry had a pH of 5.3 and a solid content of 1.1% by weight. From this pulp slurry, a paper sheet having a basis weight of 108 g/m$^2$ was produced by using a wire paper machine.

A surface of the paper sheet was coated by a coating liquid having the following composition by using a size-pressing machine.

| Component | Part by solid weight |
|---|---|
| Precipitated calcium carbonate(*)1 | 100 |
| Polyurethane ionomer(*)2 | 200 |
| Rosin compound(*)3 | 100 |
| Polyvinyl alcohol(*)4 | 20 |

Note:
(*)1Trademark: TP-121, made by Okutama Kogyo K.K.
(*)2Trademark: Hydran AP-30F, made by Dainippon Ink and Chemicals, Inc. Glass transition temperature: 61° C.
(*)3Trademark: Cellosol D-101, made by Chukyo Yushi K.K. Softening temperature: 78° C.
(*)4Trademark: PVA-117, made by Kuraray K.K.

The liquid coating layer was dried.

The resultant ink-receiving layer had a dry weight of 7.0 g/m$^2$. Also, the resultant hot melt thermal transfer recording sheet had a basis weight of 115 g/m$^2$.

The recording sheet was subjected to a surface-smoothing treatment by using a super calender. The smoothed ink-receiving layer surface had a Bekk smoothness of 400 seconds.

EXAMPLE 2

A hot melt thermal transfer recording sheet was prepared by the same procedures as in Example 1, with the following exceptions.

The coating liquid for the ink-receiving layer had the following composition.

| Component | Part by solid weight |
|---|---|
| Ground calcium carbonate(*)5 | 100 |
| Polyurethane ionomer(*)2 (Hydran AP-30F) | 200 |
| Rosin compound(*)6 | 150 |
| Polyvinyl alcohol(*)4 (PVA-117) | 20 |

Note:
(*)5Trademark: SS-2200, made by Bihoku Funka K.K.
(*)6Trademark: Super Ester E-720, made by Arakawa Kagakukogyo K.K. Softening temperature: 110° C.

EXAMPLE 3

A hot melt thermal transfer recording sheet was prepared by the same procedures as in Example 1, with the following exceptions.

The coating liquid for the ink-receiving layer had the following composition.

| Component | Part by solid weight |
|---|---|
| Precipitated calcium carbonate(*)1 (TP-121) | 100 |
| Polyurethane ionomer(*)2 (Hydran AP-30F) | 200 |
| Rosin compound(*)7 | 20 |
| Polyvinyl alcohol(*)4 (PVA-117) | 20 |

Note:
(*)7Trademark: Cellosol D-188, made by Chukyo Yushi K.K. Softening temperature: 124° C.

EXAMPLE 4

A pulp slurry was prepared by dispersing 5 parts by weight of a soft wood kraft pulp (NBKP) having a Canadian standard freeness of 480 ml and 95 parts by weight of a hard wood kraft pulp (LBKP) having a Canadian standard freeness of 480 ml, 15 parts by weight of a precipitated calcium carbonate (TP-121 (*)1), 0.5 part by weight of aluminum sulfate and 0.5 part by weight of a cationic starch and 0.5 part by weight of an alkylketene dimer in fresh water, and then adding 0.02 part by weight of an anionic polyacrylamide to the dispersion. The resultant pulp slurry had a pH of 7.9 and a solid content of 1.15% by weight. From the pulp slurry, a paper sheet having a basis weight of 108 g/m$^2$ was produced by using a wire paper machine. A surface of the paper sheet was coated by a coating liquid having the following composition by using a size-pressing machine.

| Component | Part by solid weight |
|---|---|
| Precipitated calcium carbonate(*)1 (TP-121) | 100 |
| Polyurethane ionomer(*)8 | 200 |
| Rosin compound(*)3 (Cellosol D-101) | 100 |
| Polyvinyl alcohol(*)9 | 20 |

Note:
(*)8Trademark: Hydran AP-40, made by Dainippon Ink Chemicals, Inc. Glass transition temperature: 49° C.
(*)9Trademark: PVA R-1130, made by Kuraray K.K.

The liquid coating layer was dried.

The resultant ink-receiving layer had a dry weight of 7.0 g/m$^2$. Also, the resultant hot melt thermal transfer recording sheet had a basis weight of 115 g/m$^2$.

The recording sheet was subjected to a surface-smoothing treatment by using a super calender. The smoothed ink-receiving layer surface had a Bekk smoothness of 400 seconds.

Comparative Example 1

A hot melt thermal transfer recording sheet was prepared by the same procedures as in Example 1, with the following exceptions.

The coating liquid for the ink-receiving layer had the following composition.

| Component | Part by solid weight |
|---|---|
| Precipitated calcium carbonate(*)1 (TP-121) | 100 |
| Oxidized Starch(*)10 | 200 |

Note:
(*)10Trademark: Ace A, made by Oji Corn Starch K.K. Thermal decomposition temperature: 130° C.

Comparative Example 2

A hot melt thermal transfer recording sheet was prepared by the same procedures as in Example 1, with the following exceptions.

The coating liquid for the ink-receiving layer had the following composition.

| Component | Part by solid weight |
|---|---|
| Ground calcium carbonate(*)5 (SS-2200) | 100 |
| SBR latex(*)11 | 10 |

Note:
(*)11Trademark: SBR Latex T-038, made by Nihon Goseigomu K.K. Glass transition temperature: −14° C.

Comparative Example 3

A hot melt thermal transfer recording sheet was prepared by the same procedures as in Example 1, with the following exceptions.

The coating liquid for the ink-receiving layer had the following composition.

| Component | Part by solid weight |
|---|---|
| Ground calcium carbonate(*)5 (SS-2200) | 100 |
| Oxidized Starch (Ace A)(*)11 | 200 |
| Resin compound(*)3 (Cellosol D-101) | 100 |

Comparative Example 4

A hot melt thermal transfer recording sheet was prepared by the same procedures as in Example 1, with the following exceptions.

The coating liquid for the ink-receiving layer had the following composition.

| Component | Part by solid weight |
|---|---|
| Precipitated calcium carbonate(*)1 (TP-121) | 100 |
| Polyurethane ionomer(*)2 (Hydran AP-30F) | 200 |

TEST

The recording sheets prepared in Examples 1 to 4 and Comparative Examples 1 to 4 were subjected to the following tests.

(1) Bar code printing test

A bar code was printed on each recording sheet by using a hot melt thermal transfer printer (trademark: KM P8104 C8, made by KS Systems Inc.).

(2) Evaluation of quality of printed bar code images

The printed bar code images were checked by a dot analyzer (trademark: DA-3000, made by KS Systems Inc.), at a magnification of 30. The quality of the bar code images was classified into 4 classes as follows.

| Class | Quality |
|---|---|
| 4 | Bar code images are sharp and clear and no defects are found in the images. --- Excellent |
| 3 | Very slight spread or thinning of the images, and substantially no defects are found in the images. --- Good |
| 2 | Spread, or thinning and partial blanks are found in the images. --- Slightly bad |
| 1 | Significant spread, or thinning and partial blanks are found in the images. --- Bad |

(3) Water-resistance of printed images

The printed recording sheet was immersed in water at room temperature for 3 days. After removal from the water, the images were rubbed with a rubbing bar and the changes in the rubbed images were observed and evaluated by naked eye and classified into 4 classes as follows.

| Class | Changes on images |
|---|---|
| 4 | No change was found on bar code images. --- Excellent |
| 3 | Very slight portions of bar code images were removed. --- Good |
| 2 | Certain portions of bar code images were removed. --- Slightly bad |
| 1 | Bar code images were significantly removed. --- Bad |

(4) Resistance of bar code images to hair cosmetic

The printed bar code images were rubbed with a cotton fiber mass impregnated with a hair tonic and wound around a rubbing bar 20 times under a load of 500 g/cm$^2$. Changes of the rubbed bar code images were observed and evaluated by naked eye and classified into 4 classes as follows.

| Class | Change |
|---|---|
| 4 | No change on bar code images. --- Excellent |
| 3 | Bar code images are very slightly removed. --- Good |
| 2 | Certain portions of bar code images are removed. --- Slightly bad |
| 1 | Bar code images are significantly removed. --- Bad |

(5) Applicability to offset printing (A) Dry printing surface strength

To each recording sheet, an offset printing operation was applied by using 0.5 ml of an offset printing ink (Trademark: Printing Ink SD50 T-13, made by Toka Shikisokagaku K.K.).

The surface strength of the printed ink images was observed and evaluated by naked eye and classified into 4 classes as follows.

| Class | Surface strength |
|---|---|
| 4 | No defect was found on printed ink images. --- Excellent |
| 3 | very slight defects on printed ink images were found. --- Good |
| 2 | Certain defects were found on printed ink images. --- Slightly bad |
| 1 | Significant defects were found on printed ink images. --- Bad |

(B) Wet printing surface strength

The printing surface of the recording sheet was wet with water, and an offset printing was applied to the wet surface of the recording sheet by using 0.5 ml of the offset printing ink (Printing Ink SD50 T-13).

The surface strength of the printed ink images on the wet surface was observed and evaluated by naked eye and classified into 4 classes as follows.

| Class | Surface strength |
|---|---|
| 4 | No defect on printed ink images was found. --- Excellent |
| 3 | Very slight defects on printed ink images were found. --- Good |
| 2 | Certain defects on printed ink images were found. --- Slightly bad |
| 1 | Significant defects on printed ink images were found. --- Bad |

The test results are shown in Table 1.

TABLE 1

| | | Item | | | | |
|---|---|---|---|---|---|---|
| | | Quality of bar code | Water | Hair tonic | Applicability to offset printing (Printing strength) | |
| Example No. | | images | resistance | resistance | Dry | Wet |
| Example | 1 | 4 | 3 | 3 | 3 | 3 |
| | 2 | 3 | 4 | 4 | 3 | 4 |
| | 3 | 4 | 3 | 3 | 4 | 3 |
| | 4 | 4 | 3 | 3 | 3 | 3 |
| Comparative Example | 1 | 1 | 1 | 1 | 3 | 2 |
| | 2 | 1 | 3 | 3 | 4 | 4 |
| | 3 | 1 | 2 | 1 | 3 | 3 |
| | 4 | 4 | 1 | 1 | 1 | |

Table 1 clearly shows that the hot melt thermal transfer recording materials of the examples of the present invention were advantageous in that the transferred bar code images had substantially no spread, thinning and partial blanks and the ink-receiving layer exhibited a satisfactory applicability to offset printing and an excellent water resistance.

We claim:

1. A hot melt ink-thermal transfer recording material, comprising:

a substrate; and a hot melt ink-receiving layer formed on at least one surface of the substrate and comprising a hot melt ink-receiving resin material comprising a polyurethane ionomer and a rosin compound.

2. The recording material as claimed in claim 1, wherein the polyurethane ionomer has a glass transition temperature of 90° C. or less.

3. The recording material as claimed in claim 1, wherein the rosin compound has a softening temperature of 130° C. or less.

4. The recording material as claimed in claim 1, wherein in the ink-receiving layer, the rosin compound is contained in an amount of 5 to 80 parts by weight per 100 parts by weight of the polyurethane ionomer.

5. The recording material as claimed in claim 1, wherein the rosin compound is selected from the group consisting of rosin, hydrogenated rosins, rosin esters, and hydrogenated rosin esters.

6. The recording material as claimed in claim 1, wherein the ink-receiving layer has a weight of 1 to 7 g/m$^2$ on each surface of the substrate.

7. The recording material as claimed in claim 1, wherein the substrate comprises a member selected from paper sheets, synthetic paper sheets, nonwoven fabric and synthetic resin film.

8. The recording material as claimed in claim 7, wherein the paper sheet for the substrate comprises pulp fibers and a filler in an amount of 5 to 30% based on the total weight of pulp fibers.

9. The recording sheet as claimed in claim 1, wherein the ink-receiving layer has an ink-receiving surface thereof having a Bekk smoothness of 150 seconds or more.

* * * * *

UNITED STATES PATENT AND TRADEMARK OFFICE

CERTIFICATE OF CORRECTION

PATENT NO.: 5,508,108
DATED : April 16, 1996
INVENTOR(S): Tomofumi TOKIYOSHI et al It is certified that error appears in the above-identified patent and that said Letters Patent is hereby corrected as shown below:

Cover page, Item [75] change "Tokiyoski" to --Tokiyoshi--.

Signed and Sealed this

Eighth Day of April, 1997

Bruce Lehman

*Attest:*

BRUCE LEHMAN

*Attesting Officer*

*Commissioner of Patents and Trademarks*